US007428812B2

(12) United States Patent
Montminy et al.

(10) Patent No.: US 7,428,812 B2
(45) Date of Patent: Sep. 30, 2008

(54) HYDRAULIC TOOL WITH WOBBLE PLATE TRANSMISSION

(75) Inventors: Armand T. Montminy, Manchester, NH (US); Thomas R. Faucher, Manchester, NH (US); John D. Lefavour, Litchfield, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 230 days.

(21) Appl. No.: 11/429,039

(22) Filed: May 4, 2006

(65) Prior Publication Data

US 2007/0256554 A1 Nov. 8, 2007

(51) Int. Cl.
*F04B 23/00* (2006.01)
*H01R 43/00* (2006.01)

(52) U.S. Cl. ..... 60/477; 92/12.2

(58) Field of Classification Search ..... 92/12.2, 92/71; 72/453.16; 60/477
See application file for complete search history.

(56) References Cited

U.S. PATENT DOCUMENTS

| | | | | |
|---|---|---|---|---|
| 2,388,462 | A | 11/1945 | Beeh | 103/173 |
| 2,402,244 | A * | 6/1946 | Elberty | 417/222.1 |
| 2,444,550 | A | 7/1948 | Ashton | 103/223 |
| 2,737,168 | A | 3/1956 | Chandler | 123/140 |
| 4,236,878 | A | 12/1980 | Terauchi | 417/269 |
| 4,280,359 | A | 7/1981 | Schmid et al. | 73/123 |
| 5,472,322 | A | 12/1995 | Huet et al. | 417/415 |
| 5,727,417 | A | 3/1998 | Moffatt et al. | 72/453.03 |
| 5,789,038 | A | 8/1998 | Ono | 427/437 |
| 6,162,024 | A | 12/2000 | Bruzek | 417/222.1 |
| 6,264,437 | B1 | 7/2001 | Porel | 417/390 |
| 6,446,482 | B1 | 9/2002 | Heskey et al. | 72/453.16 |
| 6,453,719 | B1 | 9/2002 | Heskey et al. | 72/453.16 |

* cited by examiner

*Primary Examiner*—Thomas E Lazo
(74) *Attorney, Agent, or Firm*—Harrington & Smith, PC

(57) ABSTRACT

A hydraulic tool including a motor; a hydraulic pump comprising only one reciprocating piston pump member; and a transmission connecting the motor to the hydraulic pump. The transmission includes a wobble plate and at least one spring. The wobble plate includes a front end pivotably connected to a frame of the pump. A rear end of the piston pump member is located against the front end of the wobble plate. The spring is spaced from the piston pump member and applies a biasing force against the front end of the wobble plate.

21 Claims, 6 Drawing Sheets

HYDRAULIC TOOL WITH WOBBLE PLATE TRANSMISSION

BACKGROUND OF THE INVENTION

1. Field of the Invention

The invention relates to a hydraulic tool and, more particularly, to a hydraulic tool having a transmission with a wobble plate.

2. Brief Description of Prior Developments

U.S. Pat. No. 5,727,417 discloses a portable battery powered crimper having a transmission with a wobble plate. U.S. Pat. No. 6,162,024 discloses a wobble plate connected to the shaft by a member with an angled front face.

One problem that can be encountered with conventional pumps having a wobble plate transmission is in regard to vibrations due to the irregular shape of the wobble plate or driving bevel disk for the wobble plate. There is a need for a design which can operate at higher rotational speeds without substantial vibrations and resulting wear.

SUMMARY OF THE INVENTION

In accordance with one aspect of the invention, a hydraulic tool is provided including a motor; a hydraulic pump comprising only one reciprocating piston pump member; and a transmission connecting the motor to the hydraulic pump. The transmission includes a wobble plate and at least one spring. The wobble plate includes a front end pivotably connected to a frame of the pump. A rear end of the piston pump member is located against the front end of the wobble plate. The spring is spaced from the piston pump member and applies a biasing force against the front end of the wobble plate.

In accordance with another aspect of the invention, a hydraulic tool is provided comprising a motor; a hydraulic pump; and a transmission connecting the motor to the hydraulic pump. The transmission comprises a wobble plate and a bevel disk rotatable relative to the wobble plate. The bevel disk comprises an angled front face. The bevel disk comprises at least one counter balance pocket which substantially balances weight of the bevel disk about a center axis of rotation of the bevel disk.

In accordance with another aspect of the invention, a hydraulic tool is provided comprising a motor; a hydraulic pump; and a transmission connecting the motor to the hydraulic pump. The transmission comprises a wobble plate. The wobble plate is prevented from axially rotating by a rotation preventing system comprising a key member connected to the wobble plate and interlocking the wobble plate with a frame of the tool to prevent axial rotation of the wobble plate relative to the frame.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
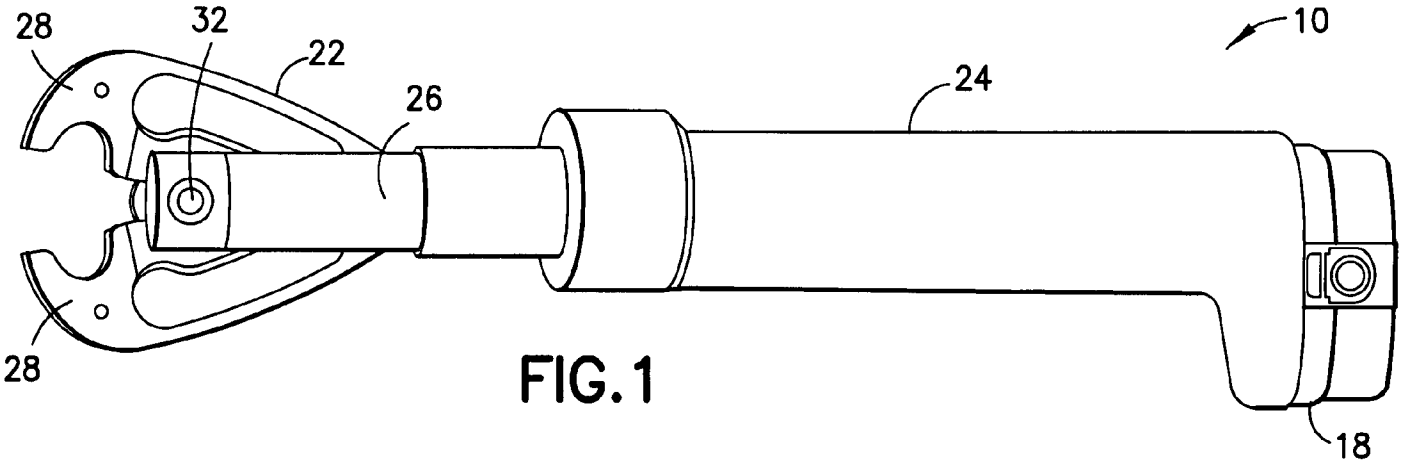
FIG. 1 is an elevational side view of a battery operated, hydraulic tool incorporating features of the invention.

Referring to FIG. 1, there is shown an elevational side view of a tool 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The tool 10 is a hydraulically operated, battery powered tool. However, features of the invention could be used in a non-battery operated tool. The tool 10 is a crimping tool for crimping an electrical connector onto a conductor, such as an electrical cable for example. However, features of the invention could be used in any suitable type of hydraulically operated tool, such as a cutting tool for example.

Figure 2:
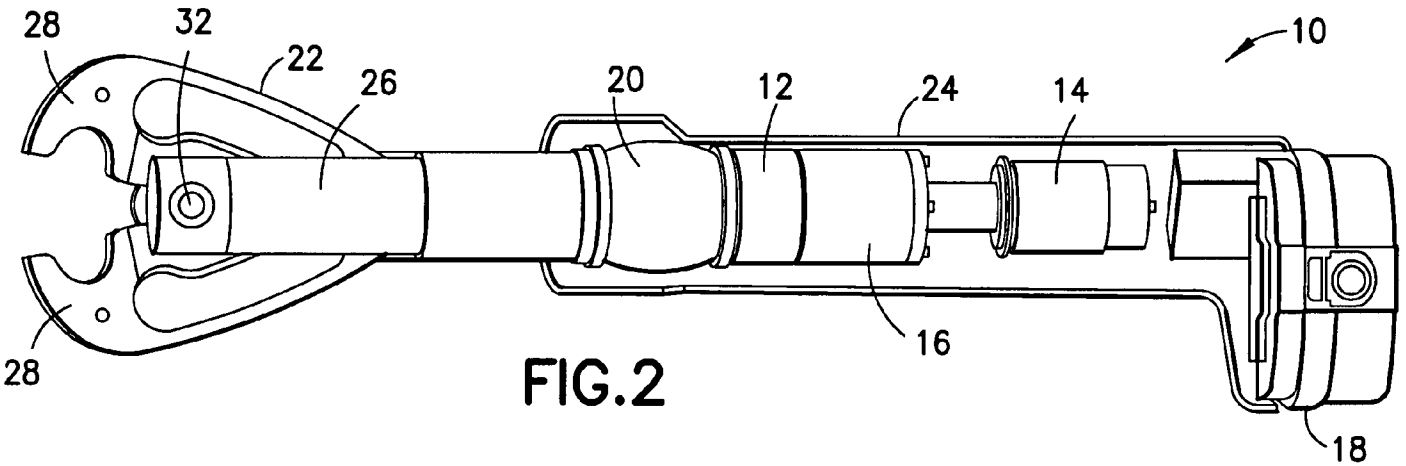
FIG. 2 is a side view of the tool shown in FIG. 1 with a cut away view of the housing.
Figure 3:
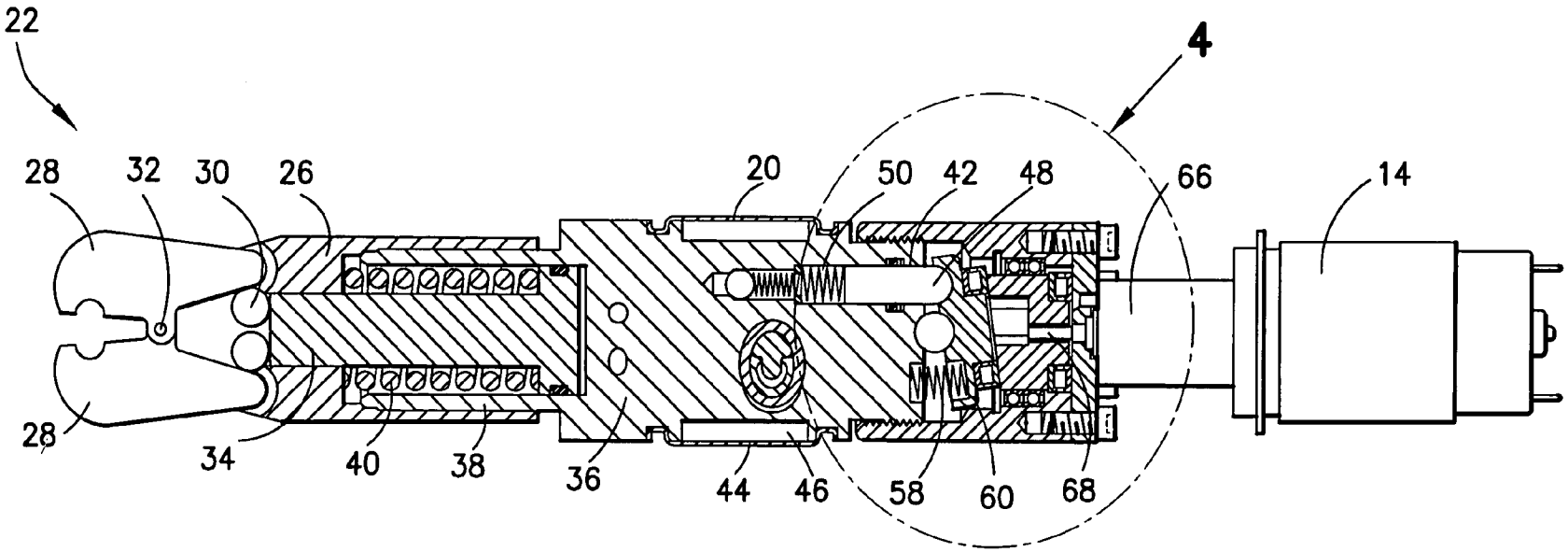
FIG. 3 is a partial cross sectional view of some of the components of the tool shown in FIGS. 1 and 2.

Referring also to FIG. 2, the tool 10 generally comprises a pump 12, a motor 14, a transmission 16 connecting the motor to the pump, a battery 18, a fluid reservoir 20, a working head 22, and a housing 24. Any suitable type of user actuated control (not shown), such as push buttons or a rocker switch for example, could be provided on the housing 24. Referring also to FIG. 3, the working head 22, in this embodiment, comprises a frame 26, two jaws 28 and rollers 30. However, in alternate embodiments any suitable type of working head could be provided. The jaws 28 are pivotably connected to the frame 26 at a pivot connection 32. The front ends of the jaws are adapted to removably receive crimping dies. The rollers 30 are located against the rear ends of the jaws 28; between the jaws. The pivot connection 32 could comprise a spring to bias the jaws 28 towards an open position when the ram 34 is in a rearward position.

The pump 12 comprises a frame 36. The frame 36 has a front end which forms a ram cylinder 38. The ram 34 is located in the ram cylinder 38 and biased towards a rearward position by a ram spring 40. The front end of the ram 34 is located against the rollers 30. The ram 34 can be moved forward by hydraulic fluid to move the rollers 30 forward and, thus, spread the rear ends of the jaws 28 apart. This causes the front ends of the jaws to be moved towards each other. The frame 36 forms hydraulic conduits from a piston channel 42 to the rear end of the ram at the ram cylinder 38. Various check valves and a release and/or relief valve are also preferably located in the hydraulic conduits. An exterior side of the frame 36 also forms part of the reservoir 20. A bladder 44 is attached at an annular recess 46 of the frame 36 to form the reservoir 20. However, in an alternate embodiment any suitable type of hydraulic fluid reservoir or hydraulic fluid supply could be provided.

Figure 4:
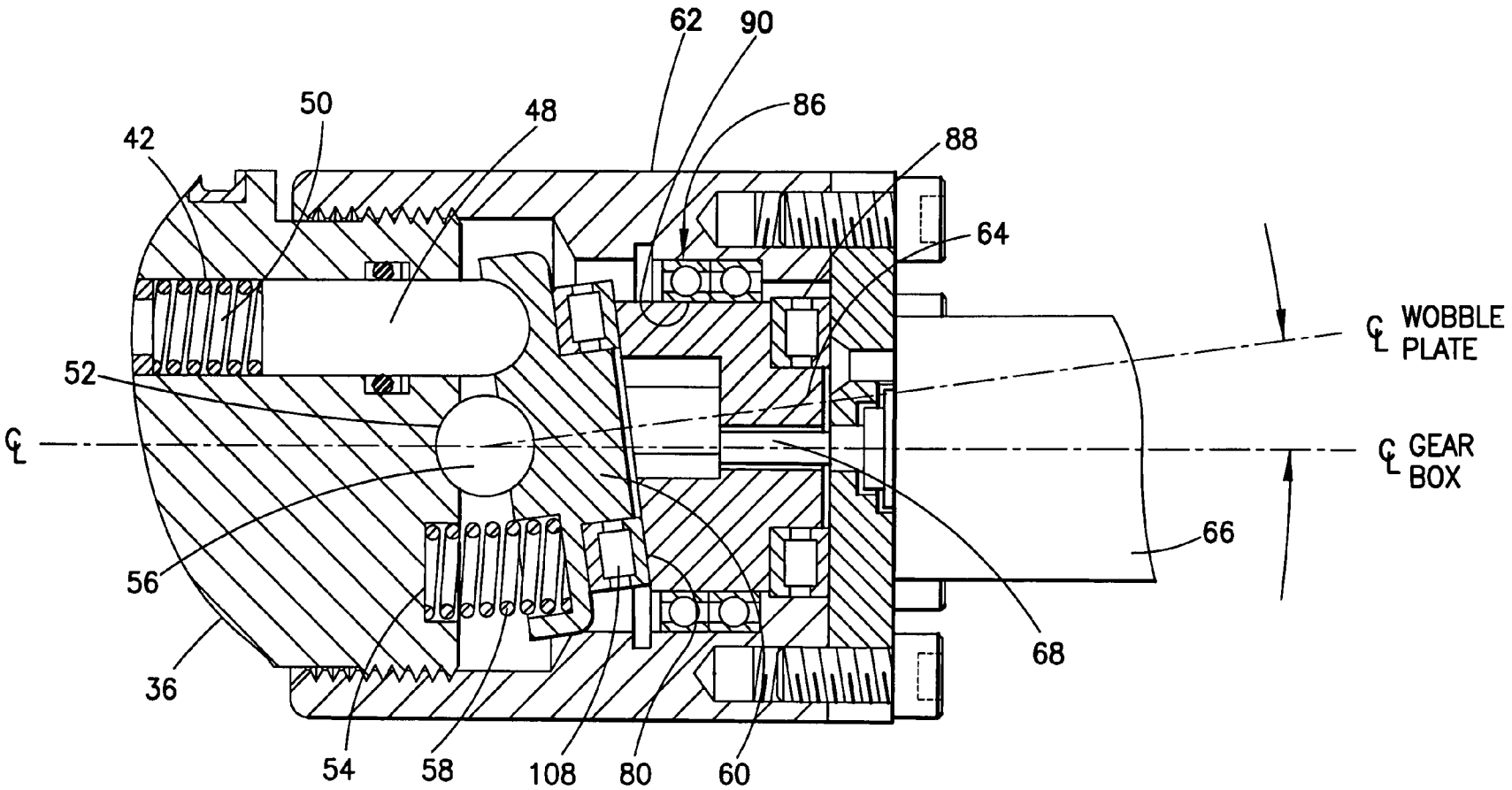
FIG. 4 is an enlarged view of portions of the pump and the transmission shown in FIG. 3.

Referring also to FIG. 4, the pump 12 comprises a piston pump member 48 located in the piston channel 42. The piston pump member 48 extends out of the rear end of the frame 36 and is biased outward by a spring 50. The piston member 48 is arranged in the piston channel 42 for reciprocating forward and backward movement. As the piston member 48 moves rearward it draws hydraulic fluid into the piston chamber from the reservoir. As the piston member 48 moves forward, it pushes that hydraulic fluid towards the ram cylinder.

The rear end of the frame 36 comprises a pivot member hole 52 and at least one spring hole 54. A pivot member 56 is pivotably located in the hole 52. In this embodiment the pivot member 56 is a ball. However, in alternate embodiments any suitable pivotable connection of the wobble plate 60 to the rear end of the frame 36 could be provided. A spring 58, such as a coil spring, is located in each of the holes 54. In this embodiment only one coil spring 58 is provided. However, in alternate embodiments two to five coil springs could be provided. The spring 58 is located on an opposite side of the rear end of the frame 36 with the pivot member 56 therebetween.

Figure 5:
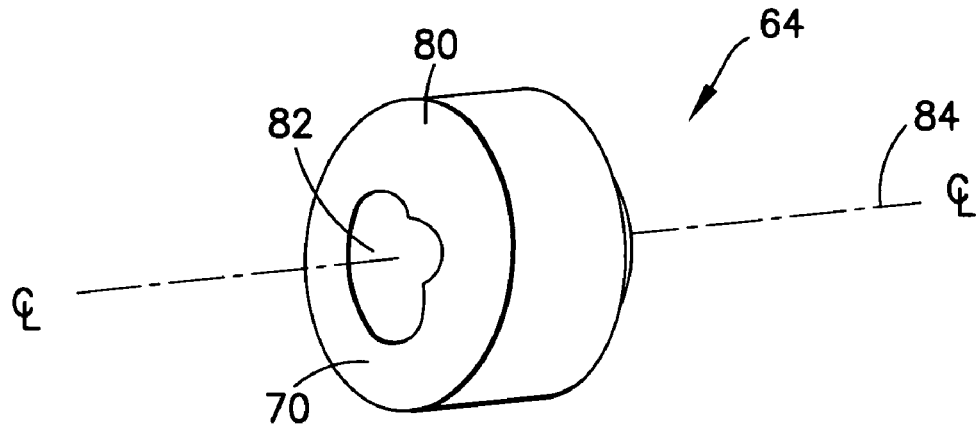
FIG. 5 is a perspective view of the bevel disk shown in FIG. 4.
Figure 6:
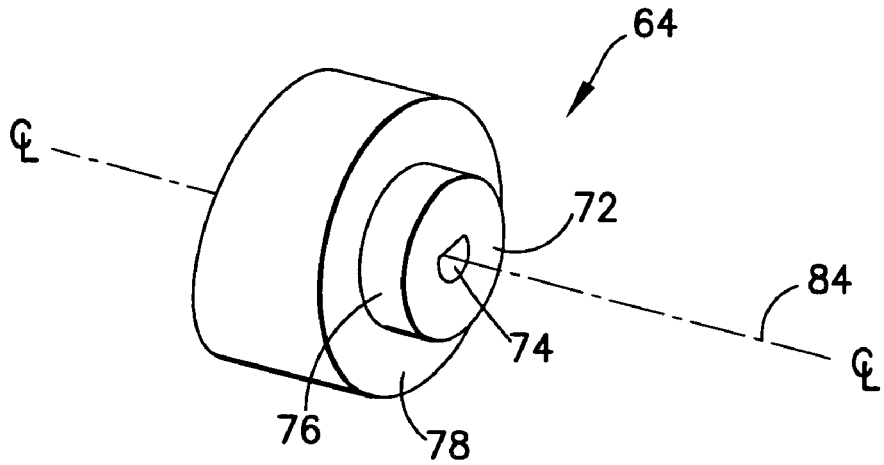
FIG. 6 is a perspective view of the bevel disk shown in FIG. 5 from a different direction.

The transmission 16 generally comprises the wobble plate 60, a transmission case 62, a bevel disk 64 and a gearbox 66. As seen in FIG. 3, the gearbox 66 is connected to an output shaft of the motor 14. The bevel disk 64 is connected to an output shaft 68 of the gearbox. Referring also to FIGS. 5 and 6, the bevel disk 64 has a general disk shape with a front end 70 and a rear end 72. The rear end 72 has a shaft bore 74 which receives the shaft 68. In this embodiment the shaft 68 has a general "D" shaped cross section. The bore 74 has a mating general "D" shaped cross section. Thus, the shapes can form a slip fit keying or mating configuration to impart rotational movement of the shaft 68 to the bevel disk 64. However, in alternate embodiments, any suitable keying or locking configuration could be provided. The rear end 72 forms an outer perimeter surface 76 and a rear facing shelf surface 78.

The front end 70 of the bevel disk 64 has an angled front face 80 which is seen best in FIG. 4. The face 80 is angled relative to the center axis 84. The front end 70 also comprises a counter balance pocket 82. In this embodiment the counter balance pocket 82 extends into the front face 80; primarily at the thicker bottom portion of the bevel disk 64. However, in an alternate embodiment more than one counter balance pocket could be provided, and/or the pocket(s) could extend into the bevel disk other than at the front face 80. In this embodiment the pocket 82 has a contoured shape. This contoured shape is provided to generally rotationally balance the disk 64 about its rotational center axis 84.

As seen best in FIG. 4, the bevel disk 64 is mounted in the transmission case 62 by a radial bearing 86 and an axial bearing 88 for rotational movement. The radial bearing 86 could comprise a radial ball bearing for example. The radial bearing 86 is located against the outer perimeter 90 of the front end 70. The axial bearing 88 could comprise a thrust bearing and thrust washers for example. The axial bearing 88 is located against the rear facing shelf surface 78 of the bevel disk 64.

Figure 7:
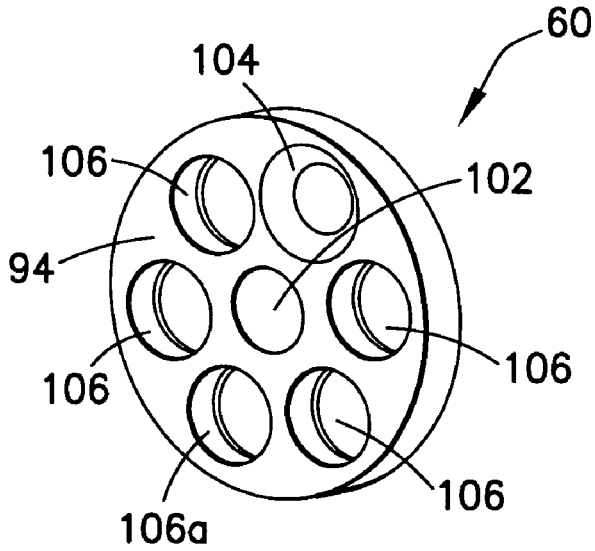
FIG. 7 is a perspective view of the wobble plate shown in FIG. 4.
Figure 8:
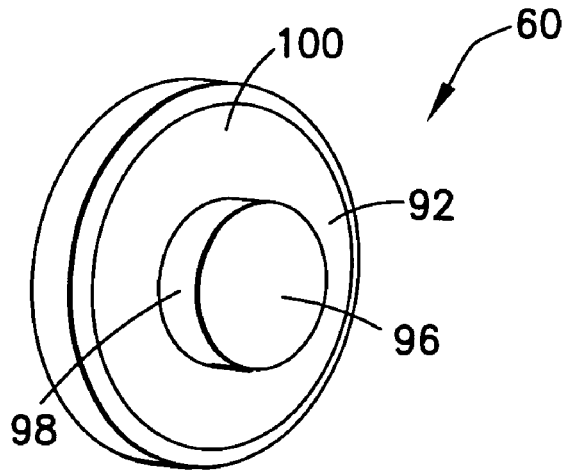
FIG. 8 is a perspective view of the wobble plate shown in FIG. 7 from a different direction.

Referring also to FIGS. 7-8, the wobble plate 60 is located in front of the bevel disk 64. The wobble plate 60 comprises a rear end 92 and a front end 94. The rear end 92 comprises a rear end projection 96 forming a perimeter surface 98 and a rearward facing shelf surface 100. The front end 94 has a front face with a center pivot pocket 102, a pump pocket 104 and five spring pockets 106. In an alternate embodiment, the front end 94 could have less than five spring pockets 106, such as only one spring pocket for example. The front end 94 could also have more than one pump pocket 104 such as when the pump has more than one piston pump member.

The front end 94 of the wobble plate 60 is located opposite the rear end of the pump's frame 36. The pivot ball 56 (see FIG. 4) is located in the hole 52 and the pocket 102 to pivotably connect the wobble plate 60 to the frame 36. In an alternate embodiment, any suitable pivotable connection could be provided, such as the pivot member 56 being integrally formed with the frame 36 or the wobble plate 60 for example. The spring 58 is located in the spring pocket **106*a*; on the opposite side of the front face from the pump pocket 104. However, in alternate embodiments, at least one other spring could be located in the one or more of the other spring pockets 106. The rear end of the piston pump member 48 is located in the pump pocket 104. The pump spring 50 keeps the rear end of the piston pump member 48 located in the pump pocket 104. The curved shape of the pump pocket 104 and rear end of the piston pump member 48 allow rotational sliding motion between the members 48, 60 as the wobble plate moves and the piston pump member 48 reciprocates in and out of the channel 42. The springs 50, 54** preferably balances out each others' biasing force.

The engagement of the spring(s) 54 and the piston pump member 48 in the pockets 104, 106, in addition to their primary functions, also perform a secondary function of forming a system for preventing the wobble plate 60 from axially rotating. However, in alternate embodiments, additional or alternative means for preventing the wobble plate from axially rotating could be provided.

A bearing 108 is provided on the rear end projection 96. The bearing 108 is located between the front face 80 of the bevel disk 64 and the shelf surface 100 of the rear end of the wobble plate 60. The bearing 108 allows the bevel disk 64 to axially rotate relative to the wobble plate 60 without the wobble plate 60 axially rotating. However, because the front face 80 of the bevel disk 64 is angled relative to its axis of rotation 84, rotation of the bevel disk 64 causes the wobble plate to pivot on the pivot member 56; effectively wobbling as the bevel disk 64 rotates. This wobbling motion causes the piston pump member 48 to reciprocally move in and out of the channel 42. Thus, rotational motion provided by the output shaft of the motor 14 can be converted into reciprocal motion of the piston pump member, and hydraulic fluid can be pumped by the pump to the ram cylinder.

Figure 9:
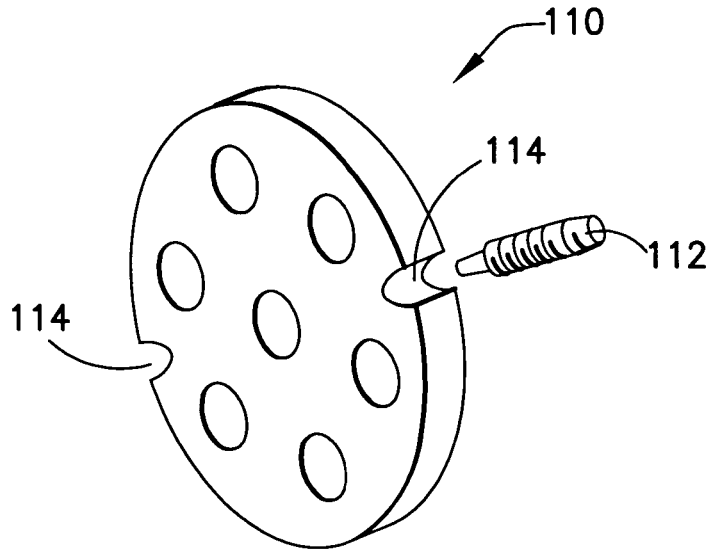
FIG. 9 is a perspective view of an alternate embodiment of the wobble plate.

Referring also to FIG. 9, an alternate embodiment of the wobble plate is shown. In this embodiment the wobble plate 110 is substantially identical to the wobble plate 60. However, the wobble plate 110 comprises screw keys 112 (only one of which is shown) which are screwed into outer perimeter holes 114 of the wobble plate 110. The screw keys 112 cooperate with the transmission case 62 to prevent the wobble plate 110 from axially rotating. This could be in addition to the springs 58 and piston pump member 48 preventing the wobble plate from axially rotating. In another alternate design, springs could be placed on the outer perimeter of the wobble plate.

Figure 10:
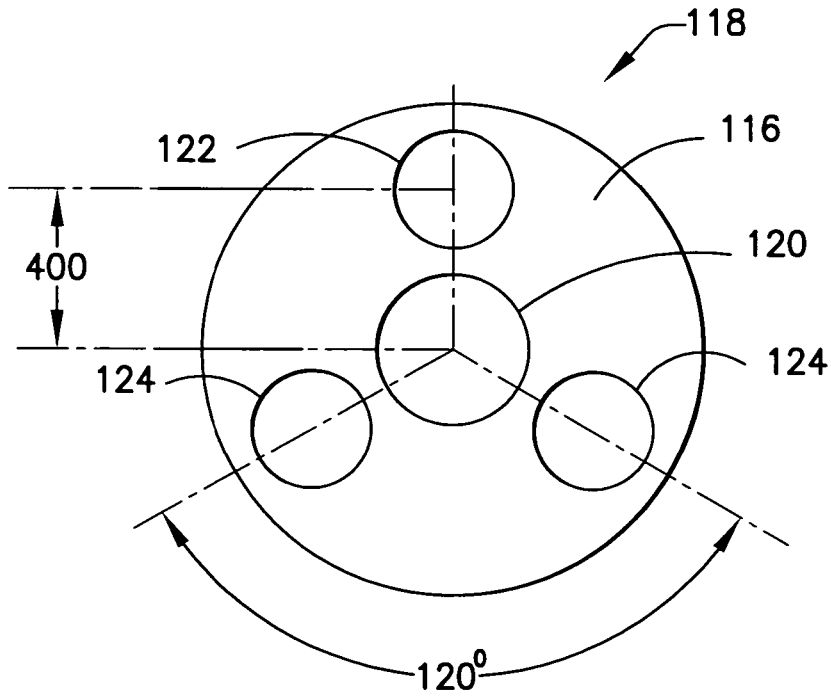
FIG. 10 is a front elevational view of another alternate embodiment of the wobble plate.

Referring also to FIG. 10, another alternate embodiment of the wobble plate is shown. In this embodiment, the front face 116 of the wobble plate 118 has a center pivot pocket 120, one pump pocket 122 and only two spring pockets 124. The pump pocket 122 and spring pockets 124 are equally spaced about the center pivot pocket 120 at 120° apart. The outer pockets 122, 124 are spaced at a center-to-center spacing from the center pivot pocket 120 at about 0.4 inch apart. However, in alternate embodiments, any suitable configuration and spacing could be provided.

With the invention, the motor 14 and transmission 16 could produce a relatively high rotational speed, such as about 17,000 rpm at 151 Watts and 13.5 Amps with a 14.4 Volt battery for example. With no load, the ram 34 could be moved its stroke length of about 0.7 inch in about 3.48 seconds for example. The bearing 86 should preferably be able to accommodate a 60 lbs load, and the bearings 88, 108 should preferably be able to accommodate a 600 lbs thrust. The distance between the forward most part of the front face 80 and the rearward most part of the front face 80 could be any suitable distance to give a pump stroke of the piston pump member of any suitable distance. These are only some examples. Any suitable configurations could be provided.

The invention can relate to a battery powered hydraulic crimp tool or cutting tool. However, the invention could alternatively be used for other applications such as swaging tools, punching tools, etc. which use a hydraulic pump drive with a wobble plate transmission.

The bevel disk/wobble plate drive system turns rotary motion into liner motion. Rotary motion is provided by the electric motor which inputs rotary motion to the gearbox. As a result the gearbox output shaft rotates. The gearbox output shaft is preferably of "D" shape (male) geometry and provides a slip fit coupling into the bevel disk which has a "D" shape (female) geometry receiving channel. When the gearbox output shaft rotates it causes the bevel disk to rotate. As the bevel disk rotates the angled face on the bevel disk causes the wobble plate to pivot about the ball. The ball can be a 5/16 inch diameter ball for example. The wobble plate does not rotate as does the bevel disk. The wobble plate is fixed from rotation via the five spring pockets and pump pocket. These pockets contain either a spring or pump member that act as wobble plate anti-rotation devices. There can exist a plurality of springs including one pump spring and five wobble plate springs that when operating provide a force varying from approximately four to ten pounds per spring. The wobble plate springs and pump member act as an anti-rotation device. In addition the combined spring forces keep the wobble plate in close contact to the thrust bearings and thrust washers. The thrust bearing and thrust washers captured between the bevel disk and wobble plate can provide a near frictionless surface and, therefore, the wobble plate is subjected to a relatively small amount of torque.

With only a small amount of torque applied to the wobble plate, the interlocking springs and pump prevent the wobble plate from rotating. However, the wobble plate can pivot about the 5/16 inch diameter ball. As the wobble plate pivots about the 5/16 inch diameter ball, the pump member moves inward and outward. This inward/outward linear motion is required to pump hydraulic oil/fluid. as the pump is moved in a direction as portrayed in the drawing, fluid is pumped to the cylinder chamber through an outlet check valve (not shown). As the pump is moved in the opposite direction (not shown) fluid is drawn from the annular reservoir through the inlet check ball. When the pump reverses direction fluid is then once again pumped across the outlet check valve to the cylinder. As the fluid is pumped to the cylinder, the ram moves outward, advancing the two cylindrical rollers, spreading the crimp jaws rear section, and closing the front jaw section on the work piece. As the crimp or cut nears completion, a pressure relief valve (not shown) reaches a predetermined pressure setting and releases high pressure fluid back to the reservoir. An audible noise signals the operator that the work cycle is completed and the operator releases the activation switch (turn the electric motor off). Any remaining fluid/pressure can manually be drained back to the reservoir through a manual release or in some cases an automatic drain valve. When either method is employed, the ram compression spring returns the ram to the home position (as shown) and the tool is once again ready for the next cycle.

The bevel disk is supported radially on the outer diameter by two radial ball bearings and axially by thrust bearings and thrust washers. The bevel disk as portrayed is designed to operate at speeds of approximately 1000-1500 rpm. Since the bevel disk rotates at relatively high speed it is desirable to have a balanced bevel disk. Unique to the bevel disk shown is a counter balance pocket cut into the angled face of the bevel disk. This counter balance pocket is of specific geometry to balance the inertia of the bevel disk for rotation of relatively high speed. This feature will make a smoother operating tool with less vibration than a non-balanced bevel disk. In addition, the bevel disk contains a "D" profile to key rotation of the gearbox. A set screw or other geometry may be used.

The wobble plate features five spring pockets and one pump pocket with equal spacing. It should be noted that there could be two spring pockets and one pump pocket equally spaced or other variation thereof. The pump spring applies force to the pump which, in turn, transmits force to the wobble plate. This force is of similar magnitude as the wobble plate springs. In addition, the interlocking or contact of the wobble plate springs and pump, restrict the wobble plate from rotating. However, the wobble plate is free to pivot about the 5/16 diameter ball. It should be noted that the ball could be of different diameter. As the wobble plate pivots it creates linear movement of the pump. It should also be noted that the pump is offset from the centerline of the gearbox by approximately 0.4 inches. The centerline of the wobble plate intersects the centerline of the gearbox on an angle.

To prevent wobble plate rotation there is yet another design variation. The outer diameter of the wobble plate could contain one or more grooves with an interlocking screw key. The screw key could be used to guide the wobble plate while it pivots about the 5/16 diameter ball. This would prevent rotation of the wobble plate. The screw key could be assembled radially through the transmission case in close proximity to the wobble plate. It should also be noted that this design portrays a single piston pump. There could be two pistons or more.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic tool comprising:

a motor;

a hydraulic pump comprising only one reciprocating piston pump member; and a transmission connecting the motor to the hydraulic pump, wherein the transmission comprises a wobble plate and at least one spring, wherein the wobble plate comprises a front end pivotably connected to a frame of the pump, wherein a rear end of the piston pump member is located against the front end of the wobble plate, and wherein the spring is spaced from the piston pump member and applies a biasing force against the front end of the wobble plate.

2. A hydraulic tool as in claim 1 wherein the front end of the wobble plate comprises a pump pocket and at least two spring pockets.

3. A hydraulic tool as in claim 2 wherein the at least one spring comprises at least two springs located in respective ones of the spring pockets.

4. A hydraulic tool as in claim 2 wherein the front end of the wobble plate further comprises a ball pocket, and the transmission further comprises a ball located in the ball pocket and pivotably supporting the wobble plate on the frame of the pump.

5. A hydraulic tool as in claim 1 wherein the front end of the wobble plate comprises a pump pocket and at least five spring pockets.

6. A hydraulic tool as in claim 1 wherein the transmission further comprises a bevel disk located at a rear end of the wobble plate, wherein the bevel disk has an angled front face and is adapted to rotate relative to the wobble plate.

7. A hydraulic tool as in claim 6 wherein the bevel disk comprises at least one counter balance pocket which substantially balances weight of the bevel disk about a center axis of rotation of the bevel disk.

8. A hydraulic tool as in claim 7 wherein the at least one counter balance pocket comprises a pocket extending into the front face of the bevel disk.

9. A hydraulic tool as in claim 6 wherein the bevel disk comprises a center shaft channel having a keying shape.

10. A hydraulic tool as in claim 6 further comprising a radial bearing between an outermost radial end of the bevel disk and a frame of the tool.

11. A hydraulic tool as in claim 10 further comprising a bearing between the bevel disk and the wobble plate.

12. A hydraulic tool as in claim 10 further comprising an axial bearing supporting the bevel disk on the frame of the tool.

13. A hydraulic tool as in claim 1 wherein the wobble plate is prevented from axially rotating by a rotation preventing system comprising a key member connected to the wobble plate and interlocking the wobble plate with a frame of the tool to prevent axial rotation of the wobble plate relative to the frame.

14. A hydraulic tool as in claim 1 wherein the wobble plate is prevented from axially rotating by a rotation preventing system comprising the at least one spring having a first end located in a pocket of the frame of the pump and a second end located in a spring pocket of the wobble plate.

15. A hydraulic tool comprising:

a motor;

a hydraulic pump; and a transmission connecting the motor to the hydraulic pump, wherein the transmission comprises a wobble plate and a bevel disk rotatable relative to the wobble plate, wherein the bevel disk comprises an angled front face, and wherein the bevel disk comprises at least one counter balance pocket which substantially balances weight of the bevel disk about a center axis of rotation of the bevel disk.

16. A hydraulic tool as in claim 15 wherein the at least one counter balance pocket comprises a pocket extending into the angled front face of the bevel disk.

17. A hydraulic tool as in claim 15 wherein the bevel disk comprises a center shaft channel having a keying shape.

18. A hydraulic tool as in claim 15 further comprising a radial bearing between an outermost perimeter of the bevel disk and a frame of the tool.

19. A hydraulic tool as in claim 18 further comprising a bearing between the bevel disk and the wobble plate.

20. A hydraulic tool as in claim 19 further comprising an axial bearing supporting the bevel disk on the frame of the tool.

21. A hydraulic tool as in claim 15 wherein the pump comprises a single piston pump member having a rear end located in a pump pocket on a front face of the wobble plate, and wherein the transmission further comprises a spring extending from the front face of the wobble plate on a side of the front face generally opposite the piston pump member.

* * * * *